US005876318A

United States Patent [19]

Ratzel

[11] Patent Number: 5,876,318

[45] **Date of Patent: *Mar. 2, 1999**

[54] CUSHIONING CONVERSION MACHINE INCLUDING A LENGTH MEASURING DEVICE

[75] Inventor: Richard O. Ratzel, Westlake, Ohio

[73] Assignee: Ranpak Crop., Concord Township, Ohio

[ * ] Notice: The term of this patent shall not extend beyond the expiration date of Pat. No. 5,571,067.

[21] Appl. No.: 795,298

[22] Filed: Feb. 4, 1997

Related U.S. Application Data

[63] Continuation of Ser. No. 462,000, Jun. 5, 1995, abandoned, which is a continuation of Ser. No. 155,116, Nov. 19, 1993, Pat. No. 5,571,067.

[51] Int. Cl.[6] ..... B05B 1/14; B26D 5/22; B31F 1/10; B41J 15/04

[52] U.S. Cl. ..... 493/30; 493/29; 83/369; 364/471.02; 226/45; 33/733

[58] Field of Search ..... 493/8, 10, 11, 493/22, 23, 29, 30, 35, 354, 359, 372, 381, 439, 440, 461, 464, 462, 465, 967; 83/363, 369; 364/470, 471, 562; 226/45, 39; 33/732, 753, 1 N, 1 PT

[56] References Cited

U.S. PATENT DOCUMENTS

| | | | |
|---|---|---|---|
| 3,322,477 | 5/1967 | Armington | 493/967 |
| 3,603,216 | 9/1971 | Johnson . | |
| 3,651,465 | 3/1972 | Law et al. . | |
| 3,743,140 | 7/1973 | Sauerbrey . | |
| 3,760,669 | 9/1973 | Rosenthal et al. . | |
| 3,799,039 | 3/1974 | Johnson | 493/464 |
| 3,814,343 | 6/1974 | Bennett | 242/56 R |
| 3,949,856 | 4/1976 | Ulber et al. | 226/45 |
| 3,964,100 | 6/1976 | Bennett | 360/95 |
| 4,026,198 | 5/1977 | Ottaviano | 93/1 |
| 4,071,911 | 1/1978 | Mazur . | |
| 4,085,662 | 4/1978 | Ottaviano | 93/1 |
| 4,109,040 | 8/1978 | Ottaviano | 428/129 |
| 4,237,776 | 12/1980 | Ottaviano | 493/382 |
| 4,548,286 | 10/1985 | Sashiki et al. . | |
| 4,557,716 | 12/1985 | Ottaviano | 493/464 |
| 4,619,635 | 10/1986 | Ottaviano | 493/36 |
| 4,650,456 | 3/1987 | Armington | 493/464 |
| 4,699,609 | 10/1987 | Kimaransky | 493/464 |
| 4,705,552 | 11/1987 | Liska et al. . | |
| 4,717,613 | 1/1988 | Ottaviano | 428/129 |
| 4,719,449 | 1/1988 | Cousseau | 33/1 PT |
| 4,750,896 | 6/1988 | Komarasky et al. | 493/367 |
| 4,884,999 | 12/1989 | Baldecci | 493/439 |
| 4,922,687 | 5/1990 | Chow | 53/472 |
| 4,924,506 | 5/1990 | Crossley et al. . | |
| 4,968,291 | 11/1990 | Baldacci et al. | 493/364 |
| 5,062,052 | 10/1991 | Sparer et al. . | |
| 5,088,972 | 2/1992 | Parker | 493/967 |

(List continued on next page.)

FOREIGN PATENT DOCUMENTS

| | | | |
|---|---|---|---|
| 0274188 | 12/1989 | German Dem. Rep. | 83/369 |
| 2741443 | 3/1979 | Germany | 83/363 |
| 3315520 | 11/1983 | Germany | 83/369 |
| 62-91697 | 4/1987 | Japan . | |
| 2 205 406 | 12/1988 | United Kingdom . | |

*Primary Examiner*—John Sipos
*Assistant Examiner*—Christopher W. Day
*Attorney, Agent, or Firm*—Renner, Otto, Boisselle & Sklar, P.L.L.

[57] ABSTRACT

A cushioning conversion machine (10) comprises a frame (36), conversion assemblies (50, 52, 54, 56) which convert a stock material into a cushioning product, and a length measuring device (12) which determines the length of the cushioning product as it is being produced. The conversion assemblies include a rotating assembly (54) and the angular movement of this assembly directly corresponds to the length of the cushioning product. The length measuring device (12) is positioned to monitor the angular movement of the rotating conversion assembly (54) and thus the length of the cushioning product. In the preferred embodiment, the rotating conversion assembly (54) is a gear assembly.

6 Claims, 3 Drawing Sheets

U.S. PATENT DOCUMENTS

| | | | |
|---|---|---|---|
| 5,109,347 | 4/1992 | Quick, Jr. et al. . | |
| 5,149,075 | 9/1992 | Crowley et al. | 493/357 |
| 5,180,157 | 1/1993 | Helit et al. . | |
| 5,194,720 | 3/1993 | Reinnagel et al. . | |
| 5,211,620 | 5/1993 | Ratzel et al. | 493/440 |
| 5,212,531 | 5/1993 | Monma | 226/45 |
| 5,303,585 | 4/1994 | Lichte . | |
| 5,322,477 | 6/1994 | Armington | 493/967 |
| 5,418,713 | 5/1995 | Allen . | |
| 5,442,983 | 8/1995 | D'Angelo et al. . | |
| 5,460,209 | 10/1995 | Jandura et al. . | |
| 5,483,052 | 1/1996 | Smith, III et al. . | |

CUSHIONING CONVERSION MACHINE INCLUDING A LENGTH MEASURING DEVICE

This is a continuation of application Ser. No. 08/462,000 filed on Jun. 5, 1995, now abandoned which is a continuation of copending application Ser. No. 08/155,116, filed Nov. 19, 1993 now U.S. Pat. No. 5,571,067.

FIELD OF THE INVENTION

This invention relates generally as indicated to a cushioning conversion machine including a length measuring device. More particularly, the present invention relates to a length measuring device which translates the rotational motion of a gear assembly into a pad length measurement.

BACKGROUND AND SUMMARY OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alterative. Paper is biodegradable, recyclable and renewable; making it an environmentally responsible choice for conscientious companies.

While paper in sheet form could possibly be used as a protective packaging material, it is usually preferable to convert the sheets of paper into a low density cushioning product. This conversion may be accomplished by a cushioning conversion machine, such as those disclosed in U.S. Pat. Nos. 4,026,198; 4,085,662; 4,109,040; 4,237,776; 4,557,716; 4,650,456; 4,717,613; 4,750,896; and 4,968,291. (These patents are all assigned to the assignee of the present invention and their entire disclosures are hereby incorporated by reference.) Such a cushioning conversion machine converts sheet-like stock material, such as paper in multi-ply form, into low density cushioning pads.

A cushioning conversion machine, such as those disclosed in the above-identified patents, may include a stock supply assembly, a forming assembly, a gear assembly, and a cutting assembly, all of which are mounted on the machine's frame. During operation of such a cushioning conversion machine, the stock supply assembly supplies the stock material to the forming assembly. The forming assembly causes inward rolling of the lateral edges of the sheet-like stock material to form a continuous strip having lateral pillow-like portions and a thin central band. The gear assembly pulls the stock material through the machine and also coins the central band of the continuous strip to form a coined strip. The coined strip travels downstream to the cutting assembly which cuts the coined strip into pads of a desired length. Typically, the cut pads are discharged to a transitional zone and then, either immediately or at a later time, inserted into a container for cushioning purposes.

With particular reference to the gear assembly, it includes loosely meshed gears between which the unconnected strip travels. The drive gear is fixedly mounted to a rotating shaft which is coupled to a motor. During operation of the machine, the gear motor rotates the shaft (and thus the drive gear) in an appropriate direction whereby the central band of the strip is grabbed by the gear teeth and pulled downstream through the nips of the gears. Thus, the gear assembly is a rotating conversion assembly which determines the production rate of the coined strip and, therefore, the cushioning products, or pads. (This "grabbing" simultaneously coins the layers of the central band together to form the coined strip.)

By selectively controlling the gear assembly (i.e., by activating/deactivating its motor) and the cutting assembly, a cushioning conversion machine can create pads of a variety of lengths. This feature is important because it allows a single machine to satisfy a wide range of cushioning needs. For example, relatively short pad lengths can be employed in connection with small and/or unbreakable articles, while longer pad lengths can be employed in connection with larger and/or fragile articles. Moreover, a set of pads (either of the same or different lengths) can be employed in connection with uniquely shaped and/or delicate articles, such as electronic equipment.

Presently, a variety of length-controlling systems are used to control pad length. For example, a manual system is available in which a packaging person manually activates the gear assembly (i.e., steps on a foot pedal) for a time period sufficient to produce a coined strip of the desired length. He/she then manually deactivates the gear assembly (i.e., releases the foot pedal) and activates the cutting assembly (i.e., pushes an appropriate button on the machine's control panel) to cut the coined strip. In this manner, a pad of the desired length is created. Alternatively, the system is designed so that a manual deactivation of the gear assembly (i.e., release of the foot pedal) automatically activates the cutting assembly.

Another technique used to control pad length is a time-repeat system. In such a length-controlling system, a timer is electrically connected to the gear assembly. The timer is set for a period (i.e., seconds) which, based on an estimated gear velocity, corresponds to the desired length of the pad. The time-repeat system is designed to automatically activate the gear assembly for the selected period and thereby, assuming the estimated gear velocity is correct and constant, produce a coined strip of the desired length. The system then deactivates the gear assembly and activates the cutting assembly to cut the coined strip into a first pad of the desired length. Thereafter, the system automatically re-activates the gear assembly to repeat the cycle so that, if the timer has not been reset, a multitude of pads of substantially the same length are continuously created.

A further available length-controlling system is a removal-triggered system. This system is similar to the time-repeat system in that it deactivates the gear assembly based on the setting of a timer. However, with the removal-triggered system, the gear assembly is not automatically reactivated. Instead, it is only re-activated when the cut pad is removed, either manually by the packaging person or mechanically by a conveyor. Upon reactivation, another pad of the same length is produced unless the timer is reset.

Yet another length-controlling system includes a length-selection system which allows a packaging person to select certain predetermined pad lengths. In such a system, a selection panel (e.g., a key pad) is provided with a plurality of length options (e.g., buttons) so that a packaging person can manually select the appropriate pad length. When a particular length option is selected, the gear assembly is automatically activated for a period of time (based on estimated gear velocity) corresponding to the selected pad length. At the expiration of this time period, the gear assembly is deactivated, and the cutter assembly is activated. The process is then repeated and, unless another length option is manually selected, a subsequent pad of the same length is produced.

In many packaging situations, the production of a single pad length is sufficient to satisfy cushioning requirements and the above-discussed automatic controlling systems are usually compatible with these situations. For example, with a time-repeat system and/or a removal-triggered system, the packaging person manually sets the timer at a period corresponding to the desired length and a plurality of pads of this length are produced. Likewise, with a length-selection system, the packaging person manually selects the desired length option and a plurality of pads of the selected length are produced.

In other packaging situations, however, single pad length production is insufficient to satisfy cushioning requirements. For example, a series of identical packaging jobs may each require a set of pads of different lengths. Alternatively, a series of widely varying packaging jobs may each require a single pad, but each job may need different sized pad. Also, a series of non-identical packaging jobs may each require a different set of pads of varying lengths.

The non-manual length controlling systems sometimes do not adequately accommodate these latter packaging situations. Specifically, in order to sequentially produce pads of different lengths, the timer on a time-repeat systems and/or a removal-triggered system must be manually reset after each pad. Likewise, if a length-selection system is used, the packaging person must continuously manually change the length option. Thus, a high degree of interaction with the cushioning conversion machine is necessary. Therefore, in order for a packaging person to properly interact with the machine, at least minimal training is necessary. Additionally, while the packaging person is interacting with the machine, he/she is not packaging thereby hindering the overall efficiency of the packaging program.

Regarding the manual length-controlling system, it can certainly be used to sequentially produce pads of different lengths. However, again, a high degree of interaction is necessary thereby requiring trained personnel and/or thereby hindering efficiency. Moreover, in both the manual and non-manual length-controlling systems, the packaging person must determine (either by experience or experiment) the appropriate pad length. For this additional reason, the use of untrained workers in sophisticated packaging situations is often impractical.

Accordingly, applicant appreciated that a more sophisticated packaging program was necessary to accommodate a full range of packaging situations, especially if untrained workers were to be used as packaging personnel. Additionally, applicant appreciated that a suitable program would automatically determine the cushioning needs of a certain box and would then automatically control the cushioning conversion machine to produce one or more pads of the appropriate length. With such a program, interaction (and thus training) would be minimal even with a series of non-identical packaging jobs which each require a different set of pads of varying lengths. Moreover, in even the simplest of packaging situations (i.e., a single pad length situation) the pads for a particular box could be produced while the packaging person is packing the previous box thereby maximizing efficiency.

Applicant further appreciated that such a sophisticated packaging program could be accomplished with a process controller which, based on the packaging needs of a certain box, would control the gear assembly and the cutting assembly to produce pads of an appropriate length. In order to accomplish this control, however, the process controller needed to receive dimensional data (i.e., length measurements) so that the control of the gear assembly and/or the cutting assembly could be properly coordinated.

Applicant therefore developed the length measuring device of the present invention. The length measuring device may be used in conjunction with a process controller to create a sophisticated packaging program. Specifically, the process controller could automatically determine the cushioning needs of a certain box and then, based on length measurements supplied by the length measuring device, automatically control the cushioning conversion machine to produce a cushioning product of the appropriate length.

More particularly, the present invention provides a cushioning conversion machine comprising conversion assemblies which convert a stock material into a cushioning product and a length measuring device which measures the length of the cushioning product as it is being produced. The conversion assemblies include a rotating conversion assembly and the angular movement of this assembly directly corresponds to the length of the cushioning product. In the preferred embodiment, the gear assembly is the rotating conversion assembly.

The length measuring device is positioned to monitor the angular movement of the rotating conversion assembly and thus the length of the cushioning products. Preferably, the length measuring device includes a rotating member and a monitor. The rotating member is attached to, and rotates with, the rotating conversion assembly and may comprise a disk with a series of openings arranged in equal circumferential increments. The monitor is positioned to monitor the angular motion of the rotating member (and thus the rotating conversion assembly) and it includes a photo-optic transmitter/receiver and a reflector. The transmitter/receiver is situated so that, as the rotating member turns, transmitted light beams will travel through its openings. The reflector is positioned to receive transmitted light beams which travel through the openings and to reflect these transmitted light beams back through the openings.

Thus, applicant's length measuring device is specifically designed to accommodate a sophisticates packaging program. Moreover, applicant's invention provides certain advantages over time-dependent systems, regardless of the sophistication of a packaging program. Specifically, in time-dependent systems, determinations are based on an estimated gear velocity. However, gear velocity has been known to deviate over the course of pad production, due to motor start-up lags, variations in stock material, the different strip profiles, and other factors. With applicant's length measuring device, these factors are irrelevant because determinations are based on the actual angular movement of the gear assembly.

These and other features of the invention are fully described and particularly pointed out in the claims. The following descriptive annexed drawings set forth in detail one illustrative embodiment, this embodiment being indicative of but one of the various ways in which the principles of the invention may be employed.

DETAILED DESCRIPTION

Figure 1:
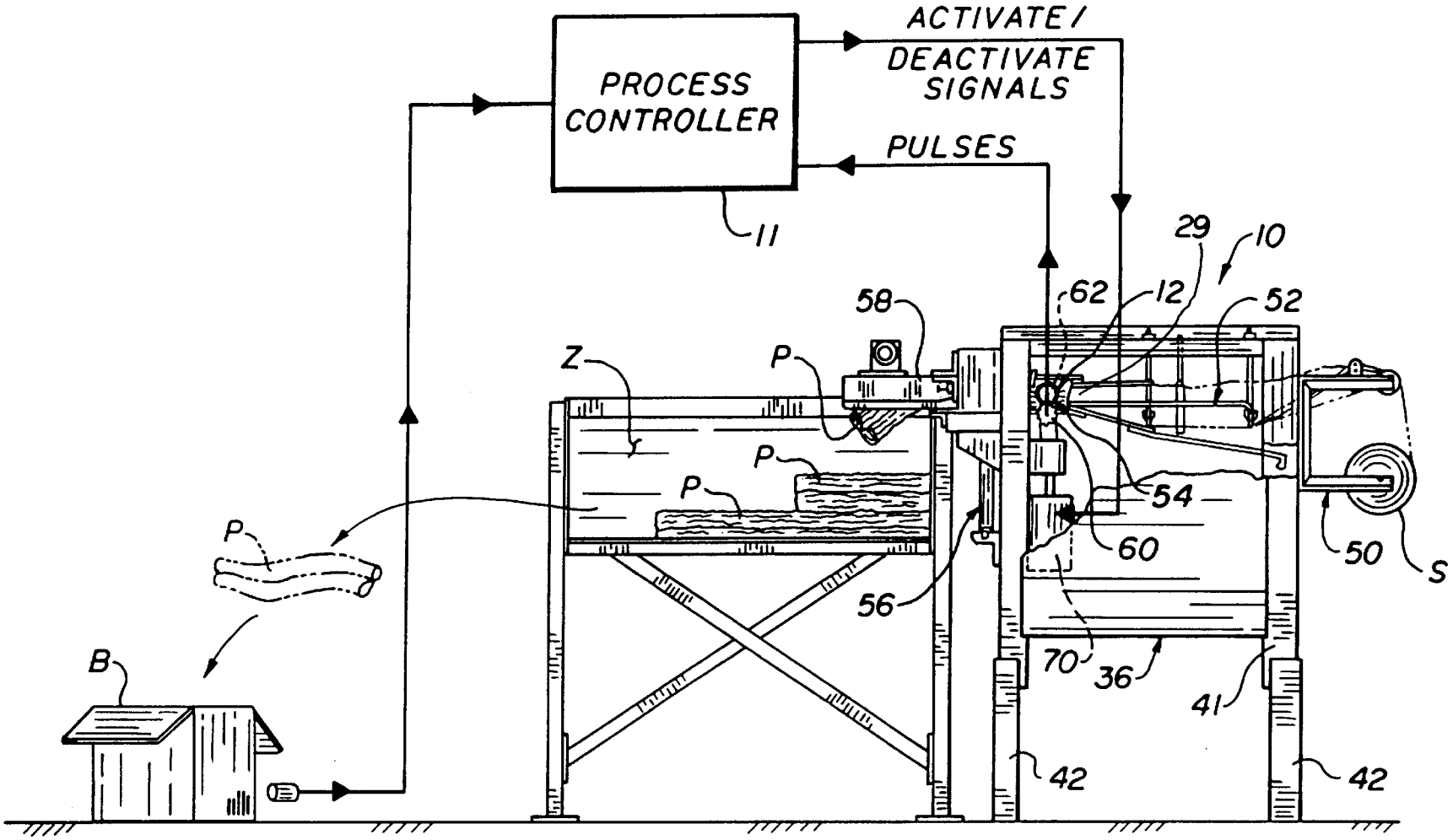
FIG. 1 is a schematic view of a packaging program, the program including a cushioning conversion machine incorporating a length measuring device according to the present invention.

Referring now to the drawings in detail and initially to FIG. 1, a sophisticated packaging program according to the present invention is shown. The packaging program includes a cushioning conversion machine 10 and a process controller 11. The process controller 11 automatically determines the packaging needs of a certain box B (i.e., by a bar code scanner) and then automatically controls the cushioning conversion machine 10 to produce pads P of the appropriate length.

The cushioning conversion machine 10 includes a length measuring device 12 which was specifically designed to accommodate such a sophisticated packaging program. Moreover, as is explained in more detail below, the device 12 is designed to determine length measurements based on the actual angular movement of a rotating gear assembly. In this manner, gear velocity (and the inaccuracies associated therewith) become irrelevant in length determinations.

Once the cushioning products P are produced by the cushioning conversion machine 10, they are transferred to a transitional zone Z. In the illustrated and preferred embodiment, the transitional zone is a slide, such as the one disclosed in a U.S. Patent Application to Beierlozer which is being filed concurrently herewith and which is entitled "Transitional Slide for Use With a Cushion-Creating Machine." This slide presents the cushioning products in an orderly sequential fashion, making it particularly advantageous in packaging situations that require the production of pads of different lengths.

In FIG. 1, the machine 10 is shown loaded with a roll of sheet-like stock material S. The stock material may consist of three superimposed webs of biodegradable, recyclable and reusable thirty-pound Kraft paper rolled onto a hollow cylindrical tube. The machine 10 converts this stock material into a continuous unconnected strip having lateral pillow-like portions separated by a thin central band. This strip is coined along its central band to form a coined strip which is cut into pads P of a desired length.

The machine 10 comprises a frame 36 and conversion assemblies mounted to the frame 36. The frame 36 includes four legs 41 (only two of which are visible in FIG. 1). In the illustrated embodiment, "stilts" 42 are provided so that the height of the machine 10 is appropriate for the transitional zone, or slide.

The conversion assemblies include a stock supply assembly 50, a forming assembly 52, a gear assembly 54, and a cutting assembly 56, all of which are mounted on the frame 36. In the preferred and illustrated embodiment, the conversion assemblies further include a pad-transferring assembly 58 which is also mounted to the frame extension 36. Such a pad-transferring assembly 58 is disclosed in a U.S. Patent Application to Simmons which is being filed concurrently herewith and which is entitled "Cushioning Conversion Machine Including a Pad-Transferring Assembly."

During operation of the machine 10, the stock supply assembly 50 supplies the stock material to the forming assembly 52. The forming assembly 52 causes inward rolling of the lateral edges of the sheet-like stock material to form the lateral pillow-like portions of the continuous strip 29. The gear assembly 54 pulls the stock material downstream through the machine and also coins the central band of the continuous strip to form the coined strip. As the coined strip travels downstream from the gear assembly 54, the cutting assembly 56 cuts the strip into pads P of a desired length. If the pad-transferring assembly 58 is used, it frictionally engages the leading portion of the coined strip prior to it being cut and then frictionally transfers the pad (formed when the coined strip is cut) to the transitional zone, or slide.

Figure 2:
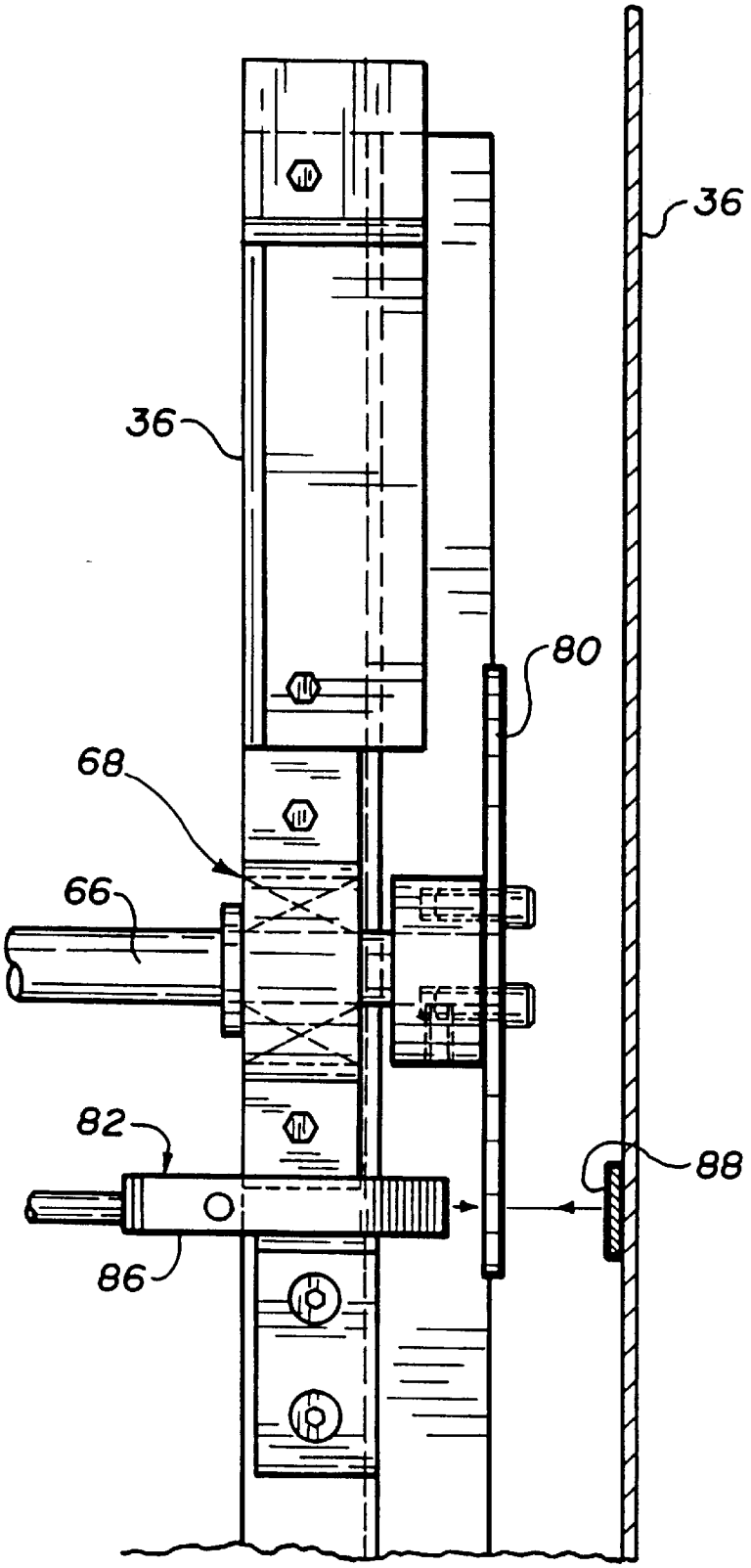
FIG. 2 is a front view of the length measuring device and other relevant portions of the cushioning conversion machine.
Figure 3:
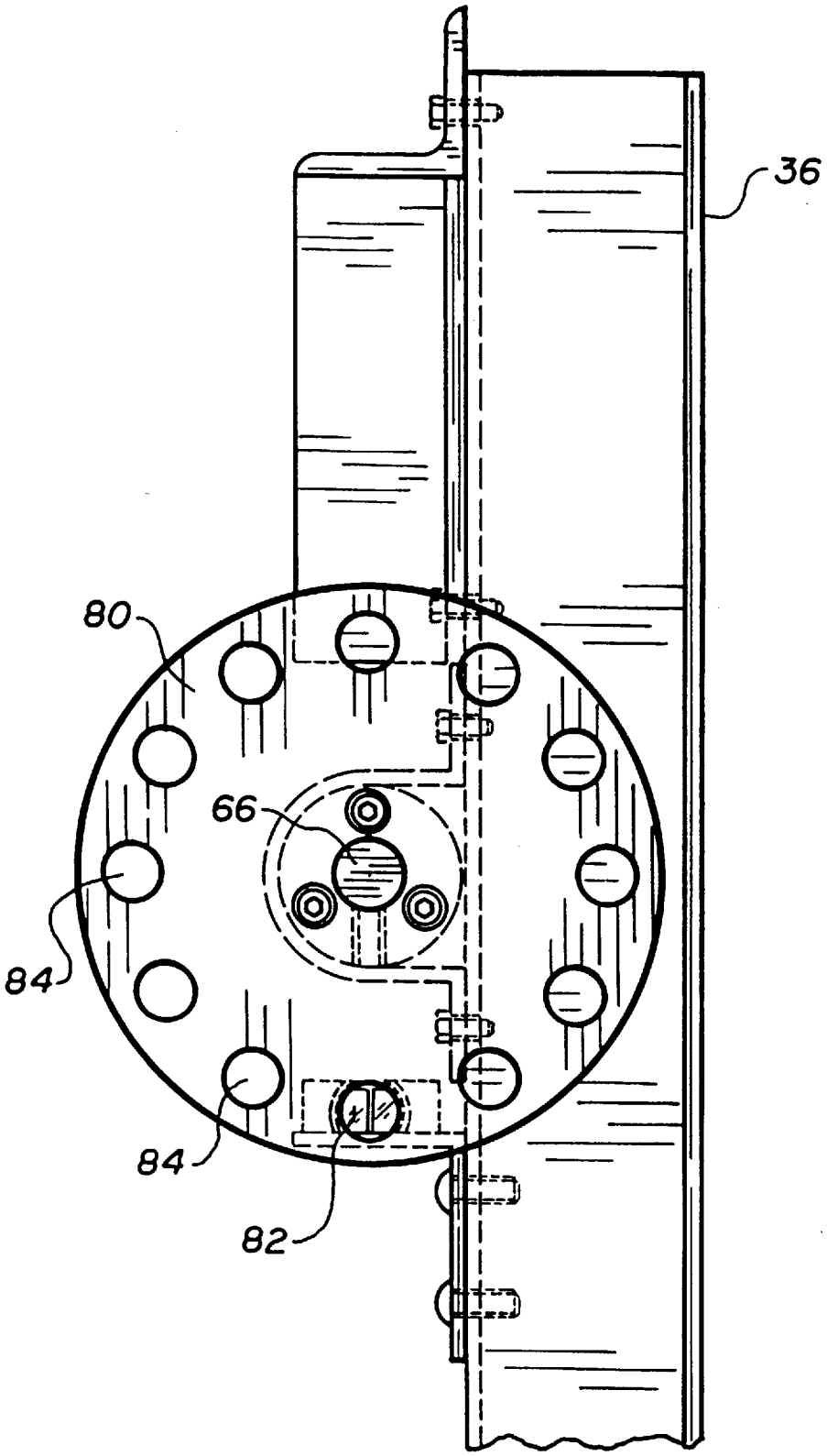
FIG. 3 is a side view of the length measuring device and other relevant portions of the cushioning conversion machine.

With particular reference to the gear assembly 54, it includes a drive gear 60 and a loosely meshed idler gear 62. (See FIG. 1.) The drive gear 60 is fixedly mounted to a shaft 66 which is rotatably mounted to the frame 36 by bearing structures 68. (See FIGS. 2 and 3.) As shown (but not specifically numbered) in FIG. 1, a sprocket at one end of the shaft 66 accommodates a chain which connects the shaft to a motor 70.

During operation of the machine 10, the gear motor 70 rotates the drive shaft 66 (and thus the drive gear 60) in an appropriate direction whereby the central band of the strip is grabbed by the gear teeth and pulled downstream through the nips of the gears 60 and 62. (This "grabbing" simultaneously coins the layers of the central band together to form the coined strip.) Thus, the gear assembly 54 is a rotating conversion assembly and its angular movement directly corresponds to the length of the coined strip and therefore the cushioning products, or pads, P. In the preferred embodiment, one revolution of the drive gear 60 produces a coined strip which is approximately twelve inches, or one foot long. In other words, every 30° increment of angular movement by the drive gear 60 corresponds to one inch of the coined strip, or pad.

The length measuring device 12 is positioned to monitor the angular movement of the gear assembly 54. In is the illustrated and preferred packaging program, angular motion data is sent to the process controller 11 to produce pads of appropriate lengths. For example, the bar code on the box B may indicate that the box requires three pads: a three foot pad, a one foot pad, and a six inch pad. To accommodate this packaging situation, the process controller 11 would activate the gear assembly 54 (i.e., send an activation signal to the motor 70), and monitor the angular motion of the drive gear 60. When the angular motion of the gear assembly 54 corresponded to three feet of cushioning product (three revolutions in the preferred embodiment), the process controller 11 would deactivate the gear assembly 54 (i.e., send a deactivation signal to the motor 70) and the cutter assembly 56 would be activated to cut the coined strip. This process would be repeated for the next two pads, except that the process controller 11 would deactivate the gear assembly 54 when its angular movement corresponded to a one foot pad length and a half-a-foot pad length, respectively (a full revolution and a half a revolution, respectively, in the preferred embodiment).

The length measuring device 12 includes a rotating member 80 which is attached to the gear shaft 66 and a monitor 82 which monitors the angular motion of the member 80, and thus the gear shaft 66. Preferably, the rotating member 80 is a disk with a series of openings 84 arranged in equal circumferential increments. More preferably, the rotating member 80 is a black, nonreflective, aluminum disk with twelve openings. In this manner, each opening 84 will correspond to a 30° angular movement and, in the preferred embodiment, one inch of pad length.

The monitor 82 comprises a photo-optic transmitter/receiver 86 which transmits and receives light beams and a reflector 88 which reflects the transmitted light beams. The transmitter/receiver 86 is mounted on the machine frame 36 and is positioned so that, as the rotating member 80 turns, transmitted light beams will travel through the openings 84. A suitable photo-optic transmitter/receiver 86 is manufactured by Banner under the catalog number SM2A312LV. It may be noted for future reference that the photo-optic transmitter/receiver 86 includes electrical circuitry capable of relaying interruptions in the receipt of light beams.

The reflector 88 is mounted on the machine frame 36 and is positioned to receive transmitted light beams which travel through the openings 84. A suitable reflector is manufactured by Opcon under catalog number 6202AXXXX.

As the rotating member 80 turns, light beams transmitted by the transmitter/receiver 86 will pass through a first opening 84, contact the reflector 88, and reflect back to the transmitter/receiver 86. Once this opening 84 rotates out of alignment with the transmitter/receiver 86 (and the reflector 88), the receipt of reflected light beams by the transmitter/receiver 86 will be interrupted until the next opening 84 moves into alignment. Thus, with the preferred rotating member 80, twelve interruptions would occur for every revolution of the member 80, and thus for every revolution of the drive gear shaft 66.

The transmitter/receiver 86 relays the occurrence of an interruption to the process controller 11 in the form of a pulse. The process controller 11 uses this information to control the gear assembly 56 (i.e., to send activation/deactivation signals to the motor 70) and thus uses this information to control pad lengths. For example, if the bar code on the box B indicated that a three foot pad was necessary, the process controller 11 would deactivate the preferred gear assembly 54 after thirty-six pulses were relayed. Likewise if a six inch pad was necessary, the process controller 11 would deactivate the preferred gear assembly 54 after six pulses were relayed.

One may now appreciate that the present invention provides a length measuring device which may be used in conjunction with a sophisticated packaging program. Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A packaging system comprising a cushioning conversion machine and a process controller;

the cushioning conversion machine comprising a frame, conversion assemblies including a feed assembly which are mounted to the frame and which convert a stock material into a cushioning product, and a length determining device which determines the length of the cushioning product as it is being produced and which monitors the operation of the feed assembly to determine the length of the cushioning product as it is being produced;

the length determining device including electric circuitry to relay length information to the process controller;

the process controller automatically determining the desired length of a cushioning product for a certain box and then automatically controlling the cushioning conversion machine, based on the length information relayed by the length determining device, to control the length of a cushioning product, wherein the feed assembly includes a rotating component and its angular movement corresponds to the length of the cushioning product and wherein the length determining device monitors the rotation of the feed assembly to determine the length of the cushioning product as it is being produced.

2. A packaging system comprising a cushioning conversion machine and a process controller;

the cushioning conversion machine comprising a frame, conversion assemblies which are mounted to the frame and which convert a stock material into a cushioning product, and a length determining device which determines the length of the cushioning product;

the length determining device including electric circuitry to relay length information to the process controller, the process controller automatically determining the desired length of a cushioning product for a certain box to be supplied with said cushioning product and then automatically controlling the cushioning conversion machine, based on the length information relayed by the length determining device, to control the length of a cushioning product.

3. A packaging system comprising a cushioning conversion machine and a process controller;

the cushioning conversion machine comprising conversion assemblies which convert a stock material into a cushioning product, and a length determining device which determines the length of the cushioning product;

the length determining device including electric circuitry to relay length information to the process controller;

the process controller automatically determining the desired length of a cushioning product for a certain box to be supplied with said cushioning product and then automatically controlling the conversion assemblies, based on the length information relayed by the length determining device, to control the length of a cushioning product.

4. A packaging system as set forth in claim 3 wherein the conversion assemblies include one conversion assembly with a moving conversion member and wherein the length determining device monitors movement of the moving conversion member.

5. A packaging system as set forth in claim 3 wherein the conversion assemblies include one rotating conversion assembly and wherein the length determining device monitors rotation of the rotating conversion assembly.

6. A packaging system comprising a cushioning conversion machine and a process controller;

the cushioning conversion machine comprising conversion assemblies which convert a stock material into a cushioning product, and a length determining device which determines the length of the cushioning product;

the length determining device including electric circuitry to relay length information to the process controller;

the process controller automatically determining a desired length of a cushioning product for a certain box and then automatically controlling the conversion assemblies to control the length of a cushioning product to produce said cushioning product of the desired length.

* * * * *

UNITED STATES PATENT AND TRADEMARK OFFICE

CERTIFICATE OF CORRECTION

PATENT NO. : 5,876,318

DATED : March 2, 1999

INVENTOR(S) : Richard O. Ratzel

It is certified that error appears in the above-identified patent and that said Letters Patent is hereby corrected as shown below:

On the title page, item [73] should read

-- Assignee: Ranpak Corp., Concord Township, Ohio --.

Signed and Sealed this

Fourth Day of April, 2000

*Attest:*

*Attesting Officer*

Q. TODD DICKINSON

*Director of Patents and Trademarks*